US009290969B2

(12) United States Patent
Yokota et al.

(10) Patent No.: US 9,290,969 B2
(45) Date of Patent: Mar. 22, 2016

(54) VEHICLE DOOR LATCH DEVICE

(75) Inventors: Yoshiaki Yokota, Sayama (JP); Minetaka Katagawa, Yokohama (JP)

(73) Assignee: MITSUI KINZOKU ACT CORPORATION (JP)

( * ) Notice: Subject to any disclaimer, the term of this patent is extended or adjusted under 35 U.S.C. 154(b) by 416 days.

(21) Appl. No.: 13/591,655

(22) Filed: Aug. 22, 2012

(65) Prior Publication Data

US 2013/0049379 A1 Feb. 28, 2013

(30) Foreign Application Priority Data

Aug. 31, 2011 (JP) ..... 2011-188943

(51) Int. Cl.

| | |
|---|---|
| ***E05C 3/06*** | (2006.01) |
| ***E05B 81/20*** | (2014.01) |
| ***E05B 81/66*** | (2014.01) |
| ***E05B 81/68*** | (2014.01) |
| *E05C 3/00* | (2006.01) |
| *E05B 77/40* | (2014.01) |
| *E05B 81/36* | (2014.01) |

(52) U.S. Cl.

CPC ..... *E05B 81/20* (2013.01); *E05B 81/66* (2013.01); *E05B 81/68* (2013.01); *E05B 77/40* (2013.01); *E05B 81/36* (2013.01); *Y10T 292/0936* (2015.04)

(58) Field of Classification Search

CPC ..... E05B 81/00; E05B 81/66; E05B 81/68
USPC ..... 292/201, DIG. 42, 216
See application file for complete search history.

(56) References Cited

U.S. PATENT DOCUMENTS

| | | | | |
|---|---|---|---|---|
| 4,762,348 | A * | 8/1988 | Matsumoto | 292/201 |
| 5,516,164 | A * | 5/1996 | Kobayashi | 292/201 |
| 5,938,252 | A * | 8/1999 | Uemura et al. | 292/201 |
| 6,019,402 | A * | 2/2000 | Arabia et al. | 292/216 |
| 6,053,543 | A * | 4/2000 | Arabia et al. | 292/201 |
| 6,109,674 | A * | 8/2000 | Bartel et al. | 292/337 |
| 6,264,253 | B1 * | 7/2001 | Takaishi | 292/216 |
| 6,416,088 | B1 * | 7/2002 | Graute | 292/216 |
| 6,499,776 | B2 * | 12/2002 | Takamura | 292/201 |
| 6,608,265 | B2 * | 8/2003 | Shinkawa | 200/61.64 |
| 6,637,783 | B2 * | 10/2003 | Takamura | 292/201 |
| 6,659,515 | B2 * | 12/2003 | Raymond et al. | 292/201 |

(Continued)

FOREIGN PATENT DOCUMENTS

| | | |
|---|---|---|
| CN | 101713268 A | 5/2010 |
| JP | 2004-116042 | 4/2004 |

(Continued)

*Primary Examiner* — Carlos Lugo
(74) *Attorney, Agent, or Firm* — Ostrolenk Faber LLP

(57) ABSTRACT

A vehicle door latch device comprises a base member having a striker-engagement groove which a striker of a vehicle body enters; a latch pivotally mounted to the base member and engagable with the striker; a ratchet pivotally mounted to the base member to engage with the latch to prevent the latch from turning; a latch-detecting switch detecting a turning position of the latch; and a synthetic resin terminal block in which a latch conductive plate is insert-molded. The terminal block has a holding portion that can hold the latch-detecting switch with an elastic claw. The latch conductive plate has a connecting terminal exposed in the holding portion and electrically connected to the latch detecting switch.

7 Claims, 13 Drawing Sheets

(56) References Cited

U.S. PATENT DOCUMENTS

| | | | | |
|---|---|---|---|---|
| 6,669,247 | B2 * | 12/2003 | Swan | 292/201 |
| 6,685,239 | B2 * | 2/2004 | Yamauchi et al. | 292/201 |
| 6,698,804 | B2 * | 3/2004 | Shiota et al. | 292/201 |
| 7,055,872 | B2 * | 6/2006 | Hayakawa et al. | 292/216 |
| 7,434,853 | B2 * | 10/2008 | Yamamoto et al. | 292/216 |
| 7,537,249 | B2 * | 5/2009 | Ichinose et al. | 292/216 |
| 8,651,536 | B2 * | 2/2014 | Kurebayashi et al. | 292/201 |
| 8,651,537 | B2 | 2/2014 | Imatomi et al. | 292/216 |
| 8,844,984 | B2 * | 9/2014 | Kurebayashi | 292/201 |
| 2001/0005079 | A1 * | 6/2001 | Takamura | 292/201 |
| 2005/0121920 | A1 * | 6/2005 | Machida | 292/201 |
| 2006/0208500 | A1 * | 9/2006 | Brown | 292/201 |
| 2006/0290142 | A1 * | 12/2006 | Tani et al. | 292/201 |

FOREIGN PATENT DOCUMENTS

| | | |
|---|---|---|
| JP | 2004-300826 | 10/2004 |
| JP | 2005-090100 | 4/2005 |

* cited by examiner

VEHICLE DOOR LATCH DEVICE

BACKGROUND OF THE INVENTION

The present invention relates to a vehicle door latch device comprising a detecting switch for detecting a position of a latch.

A vehicle door latch device comprises a base member fixed to a door; a latch which engages with a striker of a vehicle body when the door is closed; a latch-detecting switch for detecting a turning position of the latch; and a ratchet detecting switch for detecting a turning position of the ratchet. The latch detecting switch detects a half-latch position of the latch to drive a motor thereby allowing the latch to turn from a half-latch position to a full-latch position and forcing the door from a slightly-open state to a completely-closed state as described in JP2004-116042A.

However, in the vehicle door latch device as above, it is necessary to fix the detecting switch at a predetermined position by coupling means such as bolts. It is also necessary to provide wire harness for supplying a detected signal from the detecting switches to the outside. Efficiency for connecting the detecting switches is very poor.

In view of the disadvantages, it is an object of the present invention to provide a vehicle door latch device that enables detecting switches to be connected more efficiently without wire harness.

DETAILED DESCRIPTION OF PREFERRED EMBODIMENT

One embodiment of the present invention will be described as below.

A door latch device 1 is disposed at the lower end of a liftgate (not shown) which is pivotally coupled at the upper end to the rear end of a vehicle body via a hinge shaft (not shown) to open and close vertically. The door latch device 1 comprises an engagement unit 2 that engages with a striker S fixed to the vehicle body in FIGS. 6 and 7 to hold the liftgate at a closed position, and an operation unit 3 that provides a closing function in which the operation unit 3 shifts the engagement unit 2 electrically from a half-latch state where the liftgate is not shut properly to a full-latch state in which the liftgate is completely closed and a releasing function for releasing the engagement of the engagement unit 2 to enable the liftgate to open.

Figure 10:
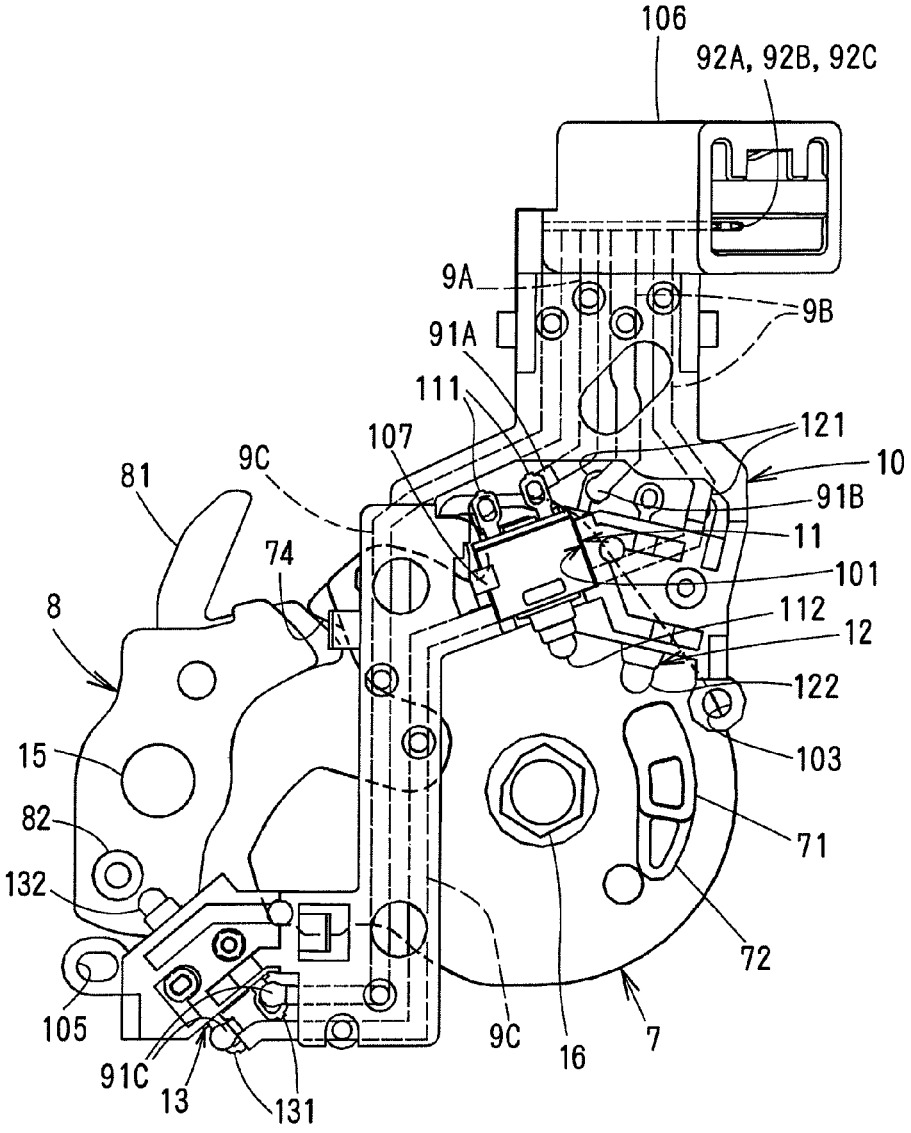
FIG. 10 is a top plan view of the main part of the engagement unit.

The engagement unit 2 comprises a metal cover plate 4 which is fixed to the lower end of the liftgate with a bolt (not shown) to form a base member; a metal back plate 5 on the cover plate 4 and fixed to the liftgate with the cover plate 4; a synthetic resin body 6 fixed between the cover plate 4 and the back plate 5 to form the base member with the cover plate 4; a latch 7 and a ratchet 8 which are pivotally mounted between the upper surface of the cover plate 4 and the lower surface of the body 6; a synthetic resin terminal block 10 in which a half-latch conductive plate 9A, a full-latch conductive plate 9B and a ratchet conductive plate 9C are formed by insert molding in FIG. 10; a half-latch detecting switch 11 and a full-latch detecting switch 12 that can detect a turning position of the latch 7; a ratchet detecting switch 13 that can detect turning positions of the ratchet 8; and a latch lever 14 that can rotate with the latch 7.

The cover plate 4 has mounting portions 42,42 at each side of a base 41 supporting the body 6. In the middle of the base 41, there is formed a striker-engagement groove 411 which the striker S enters when the liftgate is closed. In each of the mounting portions 42, there is a mounting hole 421 in which a bolt (not shown) for fixing the cover plate 4 to the liftgate is disposed.

The back plate 5 comprises a base 51 which holds the upper surface of the body 6, and mounting portions 52,52 at each side of the base 51 disposed on the upper surface of the mounting portions 42 of the cover plate 4. The base 51 is integrally molded with the mounting portions 52,52. In each of the mounting portions 52,52, there is formed a internally threaded hole 521 which engages with a bolt (not shown) upward to fix the cover plate 4 to the liftgate.

Figure 5:
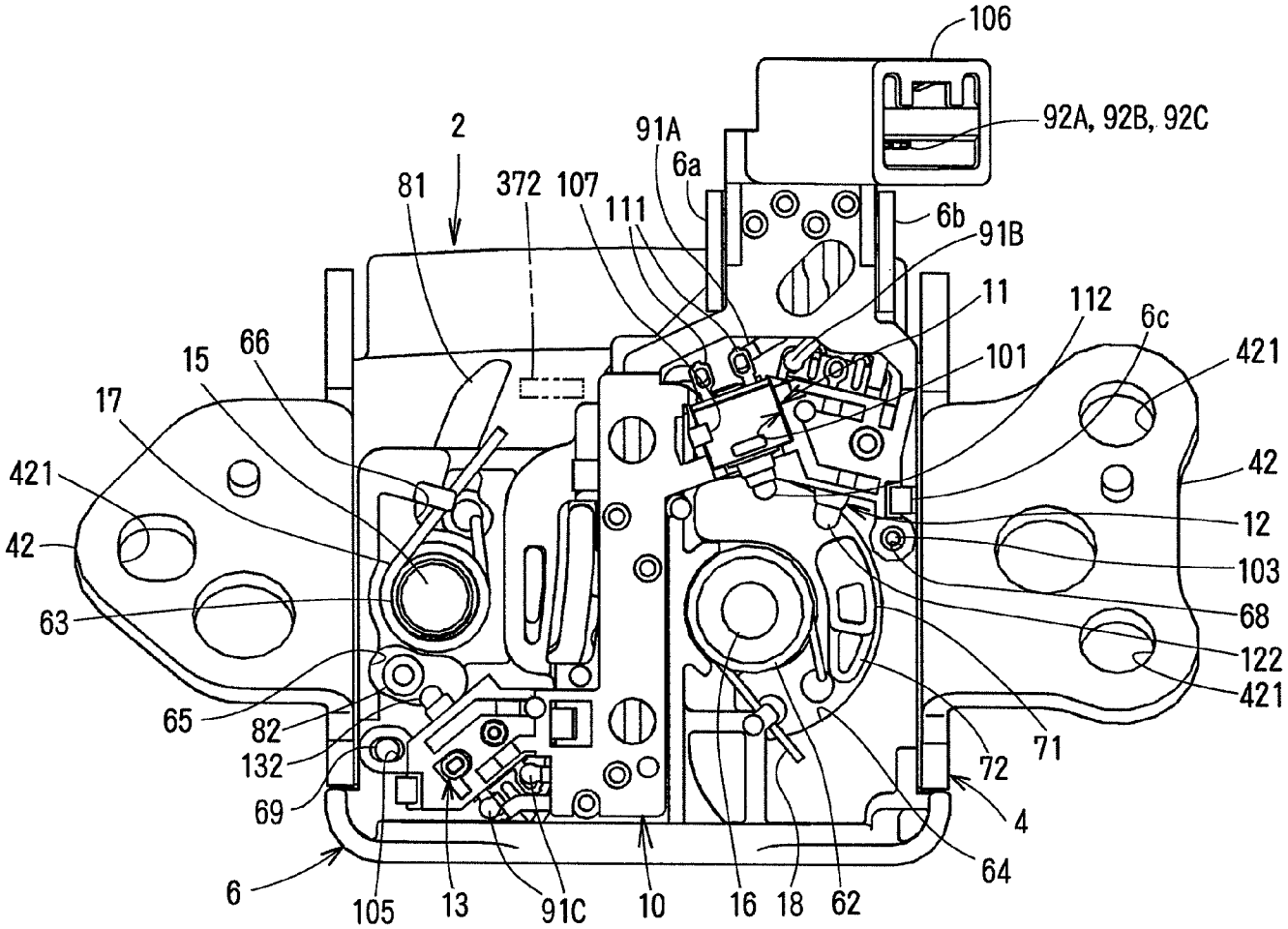
FIG. 5 is a top plan view of an engagement unit from which a back plate is removed.
Figure 11:
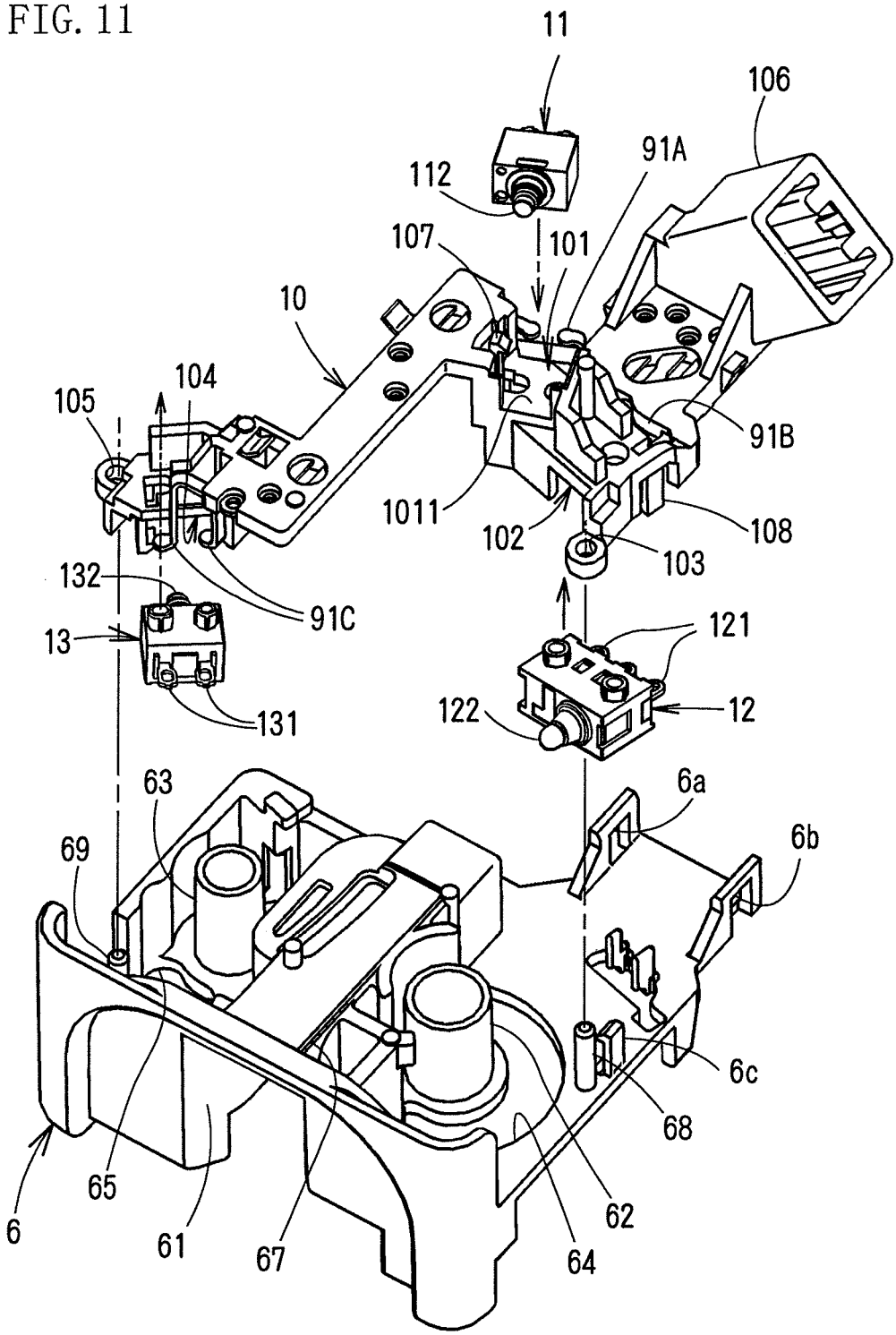
FIG. 11 is a perspective view of the body and a terminal block.
Figure 12:
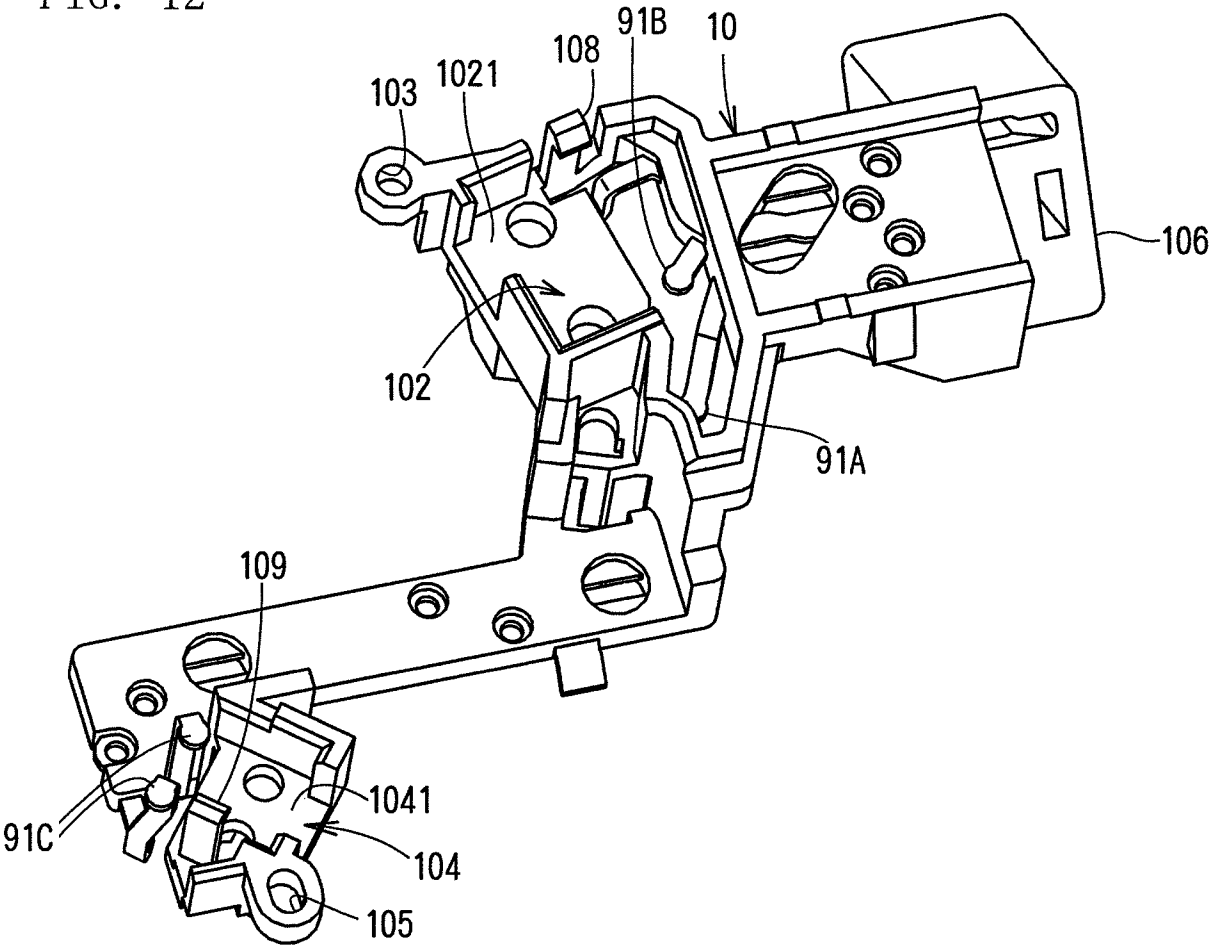
FIG. 12 is a perspective view of the terminal block.

In FIG. 11, in the body 6, there are integrally formed a striker-engagement groove 61 which is open forward and downward and overlaps on the striker-engagement groove 411 of the cover plate 4; a cylindrical support portion 62 which extends vertically at the right of the striker-engagement groove 61; a cylindrical support portion 63 which extends vertically at the left of the striker-engagement groove 61; arc-shaped openings 65,66 in FIG. 5 around the cylindrical support portion 63; a groove cover 67 surrounding the striker-engagement groove 61: right and left positioning projections 68,69 for the upward-projecting terminal block 10; and claws 6*a*-6*c* which project upward and engage with the terminal block 10 to hold the terminal block 10 on the body 6.

Between the cover plate 4 and the body 6, the latch 7 is pivotally mounted via a pivot shaft 16 rotatably disposed in the cylindrical support portion 62 of the body 6 at the right striker-engagement grooves 411,61. The latch 7 is forced by a spring 18 wound on the cylindrical support portion 62 in an opening direction or a counter-clockwise direction in FIGS. 6 and 7. As the liftgate closes, the latch 7 turns from the open position as shown by a double-dashed line in FIG. 7 to a full-latch position in which the latch 7 completely engages with the striker S in FIG. 6 via the half-latch position in which the latch 7 slightly engages with the striker S as shown by a solid line in FIG. 7.

The surface of the latch 7 is molded of synthetic resin. A first detected portion 71 and a second detected portion 72 which is lower than the first detected portion 71 are integrally molded with the latch 7 on a rotary surface of the latch 7. The first and, second detected portions 71,72 go through the arc-shaped opening 64 of the body 6 and project from the upper surface of the body 6.

The latch lever 14 is fixed to the upper end of the pivot shaft 16 which turns together with the latch 7. A cylindrical projection 141 is fixed at the end of the latch lever 14.

Between the cover plate 4 and the body 6, the ratchet 8 is pivotally mounted at the left side of the striker-engagement grooves 411,61 via a vertical pivot shaft 15 rotatably disposed in the cylindrical support portion 63 of the body 6. The ratchet 8 is forced by a spring 17 wound on the cylindrical support portion 63 in a direction of engagement or in a clockwise direction in FIGS. 6 and 7. With closing of the liftgate, the latch 7 turns from the open position to the half-latch position, and the ratchet 8 engages with a half-latch pawl 73 of the latch 7 by force of the spring 17 in FIG. 7. The latch 7 turns to the full-latch position, and the ratchet 8 engages with the full-latch pawl 74 of the latch 7 to prevent the latch 7 from turning in a direction of opening or in a counterclockwise direction in FIG. 6. A cylindrical detected portion 82 is fixed to the end of the ratchet 8. The detected portion 82 goes through the arc-shaped opening 65 upward and projects from the upper surface of the body 6.

Figure 6:
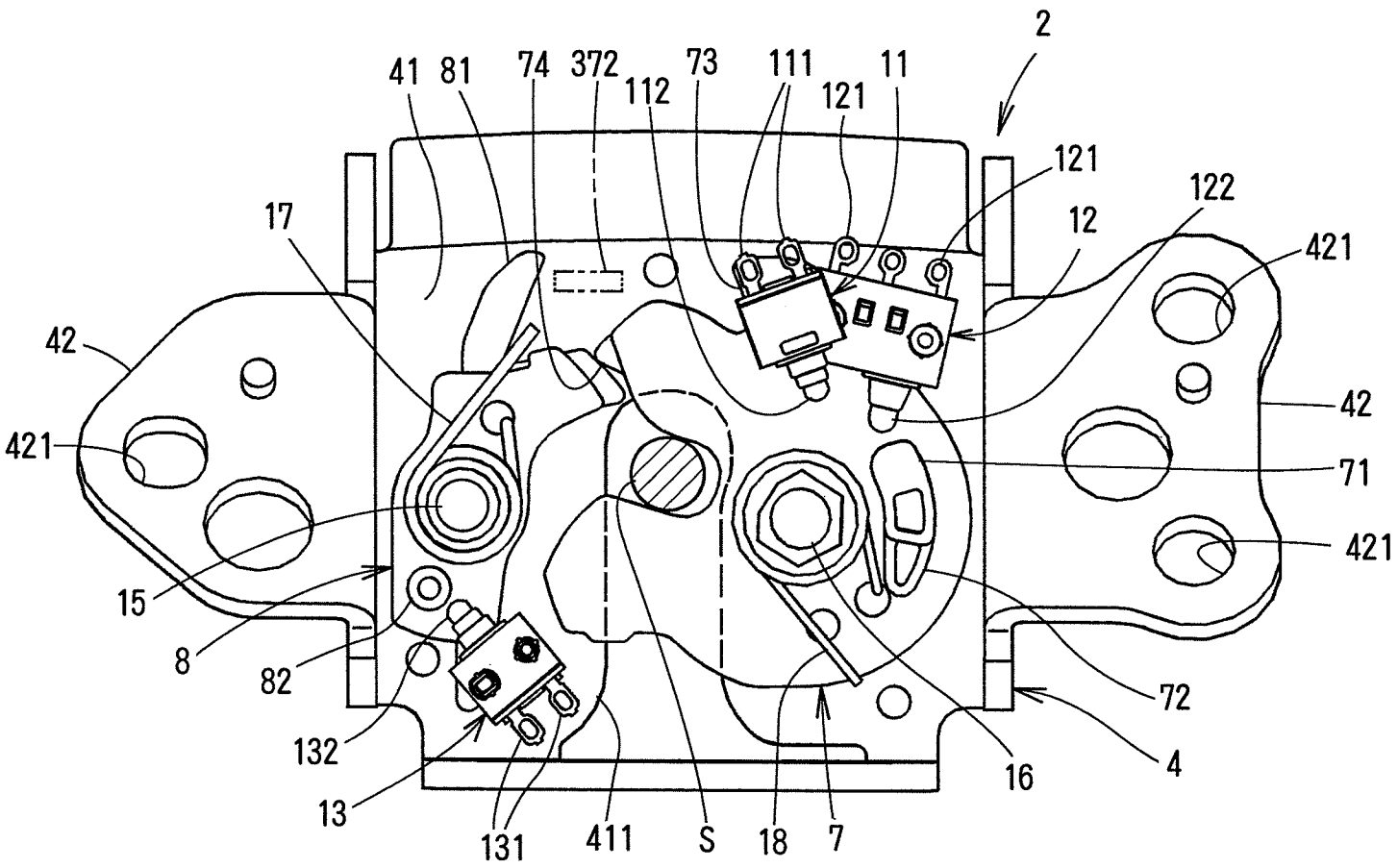
FIG. 6 is a top plan view of the engagement unit in a full-latch state from which a body and back plate are removed.
Figure 7:
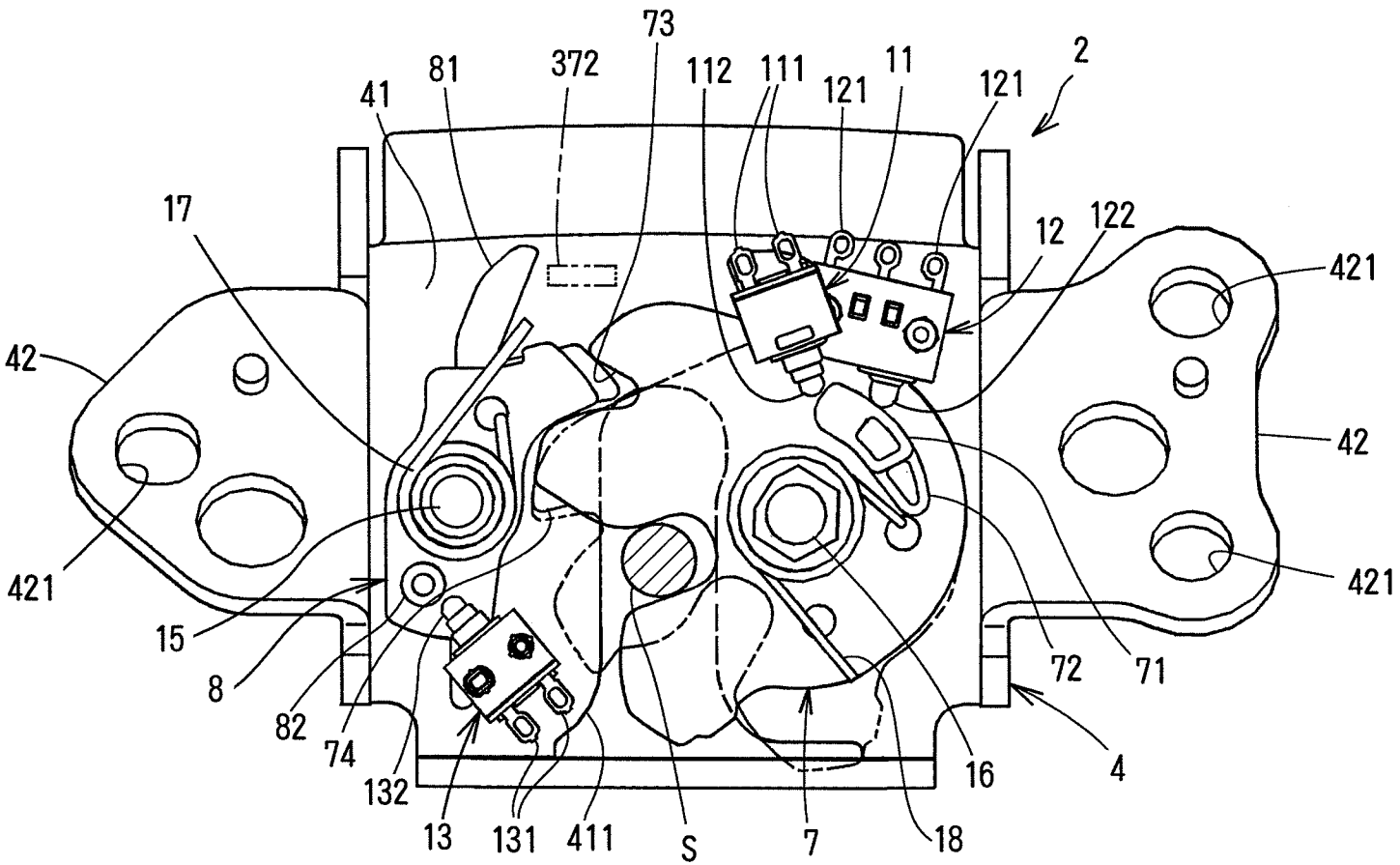
FIG. 7 is a top plan view of the engagement unit in a half-latch state from which the body and back plate are removed.
Figure 8:
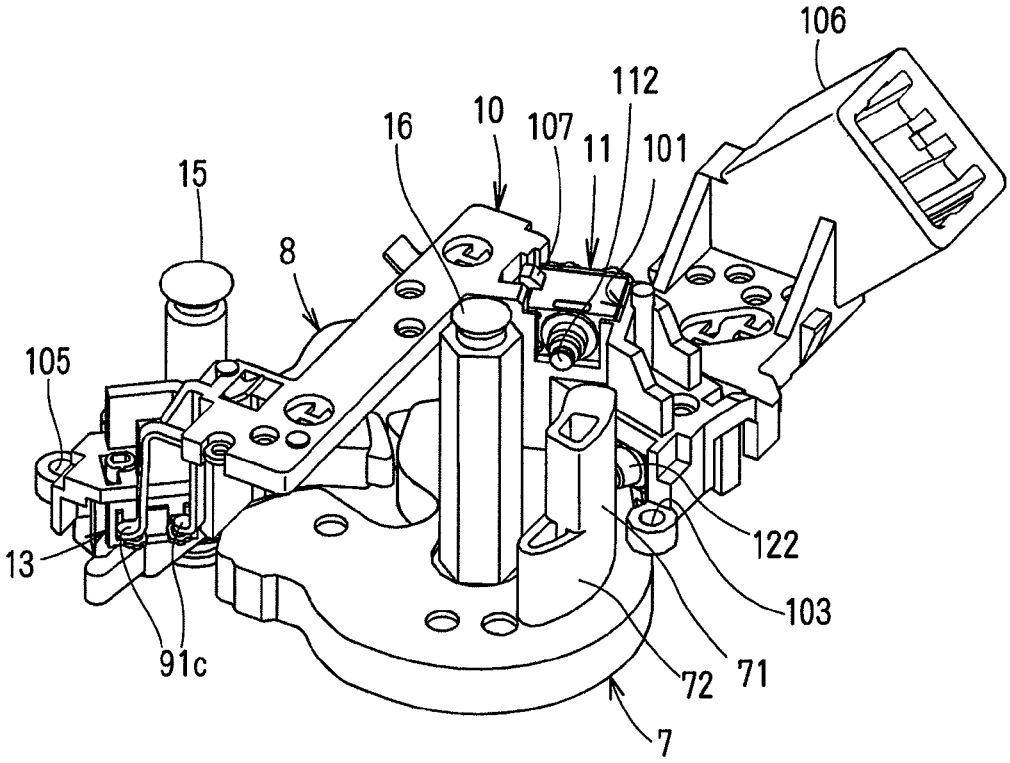
FIG. 8 is a perspective view of the main part of the engagement unit.
Figure 9:
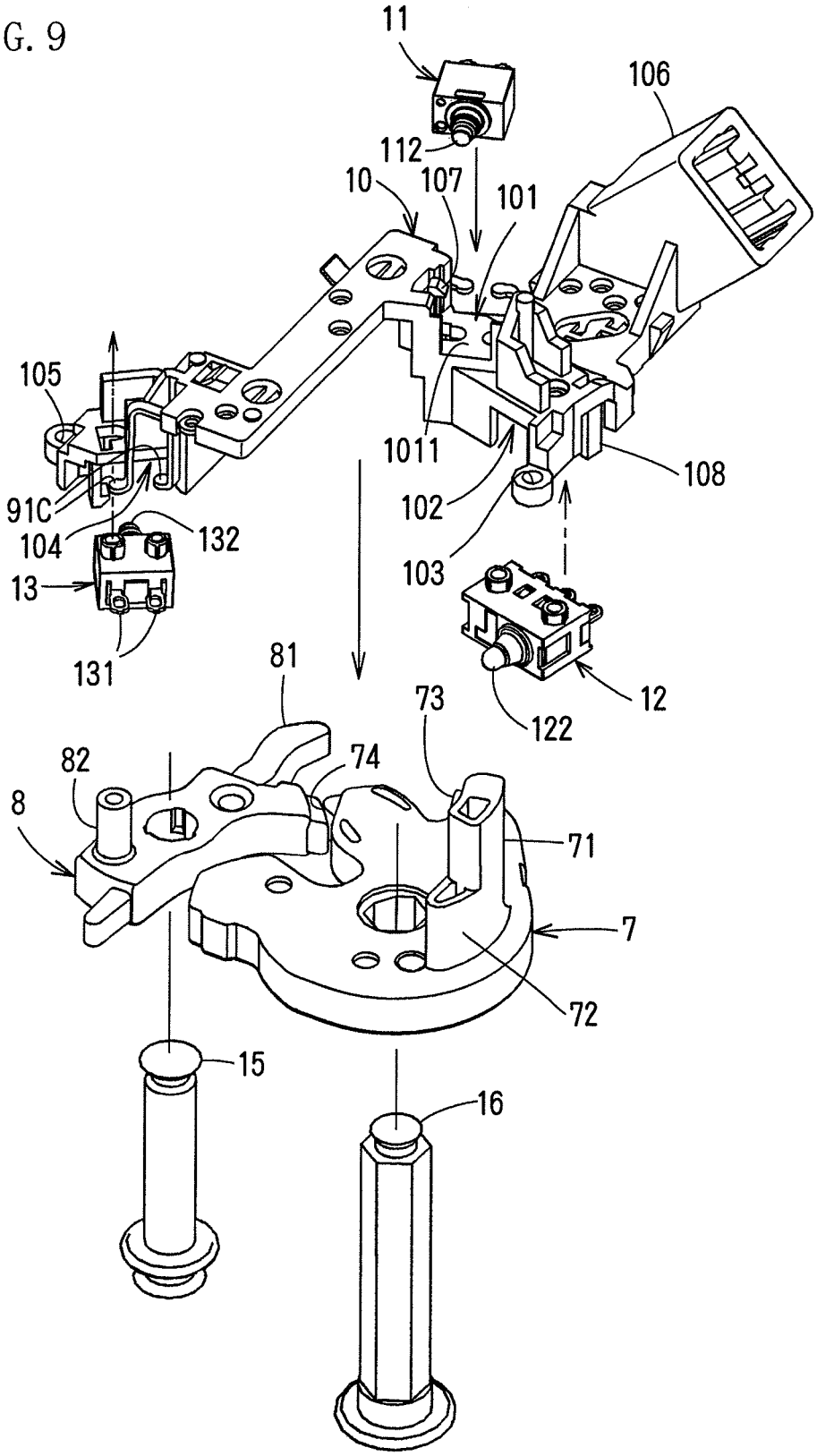
FIG. 9 is an exploded perspective view of the main part of the engagement unit.

In FIG. 7, when the ratchet 8 engages on the half-latch pawl 73 of the latch 7, the latch 7 is prevented from turning in the direction of opening or in the counterclockwise direction, so that the liftgate is held in the position in which the liftgate is not shut properly. In FIG. 6, when the ratchet 8 engages on the full-latch pawl 74 of the latch 7, the latch 7 is held in the full-latch position, the liftgate is held in a completely-closed position. When the ratchet 8 turns against the force of the spring 17 in the releasing direction or in the counterclockwise direction in FIGS. 7 and 8, the ratchet 8 disengages from the half-latch pawl 73 or full-latch pawl 74 thereby releasing the latch 7 from the striker S to enable the liftgate to open.

The operation unit 3 comprises a metal base plate 31 fixed to the cover plate 4 of the engagement unit 2; a motor 32 fixed to the back surface of the base plate 31; a sector gear 35 pivotally mounted to the front surface of the base plate 31 via a pivot shaft 33 to reduce the rotation of the motor 32 to mesh with a pinion 34; an opening lever 37 pivotally mounted to a bent portion 53 of the back plate 5 of the engagement unit 2; and a sector gear detecting switch 38 that can detect a turning position of the sector gear 35.

The base plate 31 comprises mounting portions 311,311 held between the mounting portion 42 of the cover plate 4 and the mounting portion 52 of the back plate 5 and fixed to the cover plate 4, and a switch-mounting portion 312 pressed in front of the pinion 34.

Figure 1:
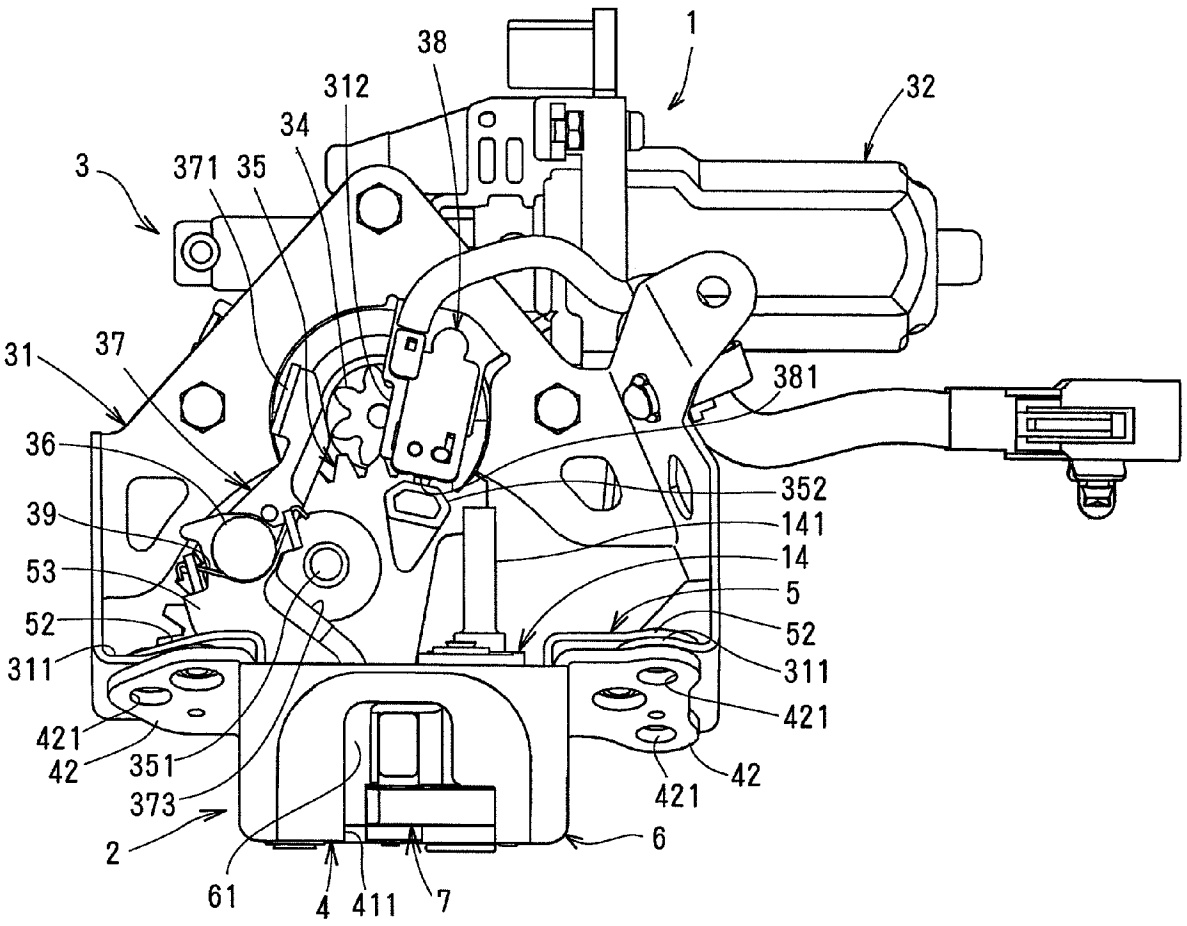
FIG. 1 is a front elevational view of a door latch device according to the present invention.
Figure 2:
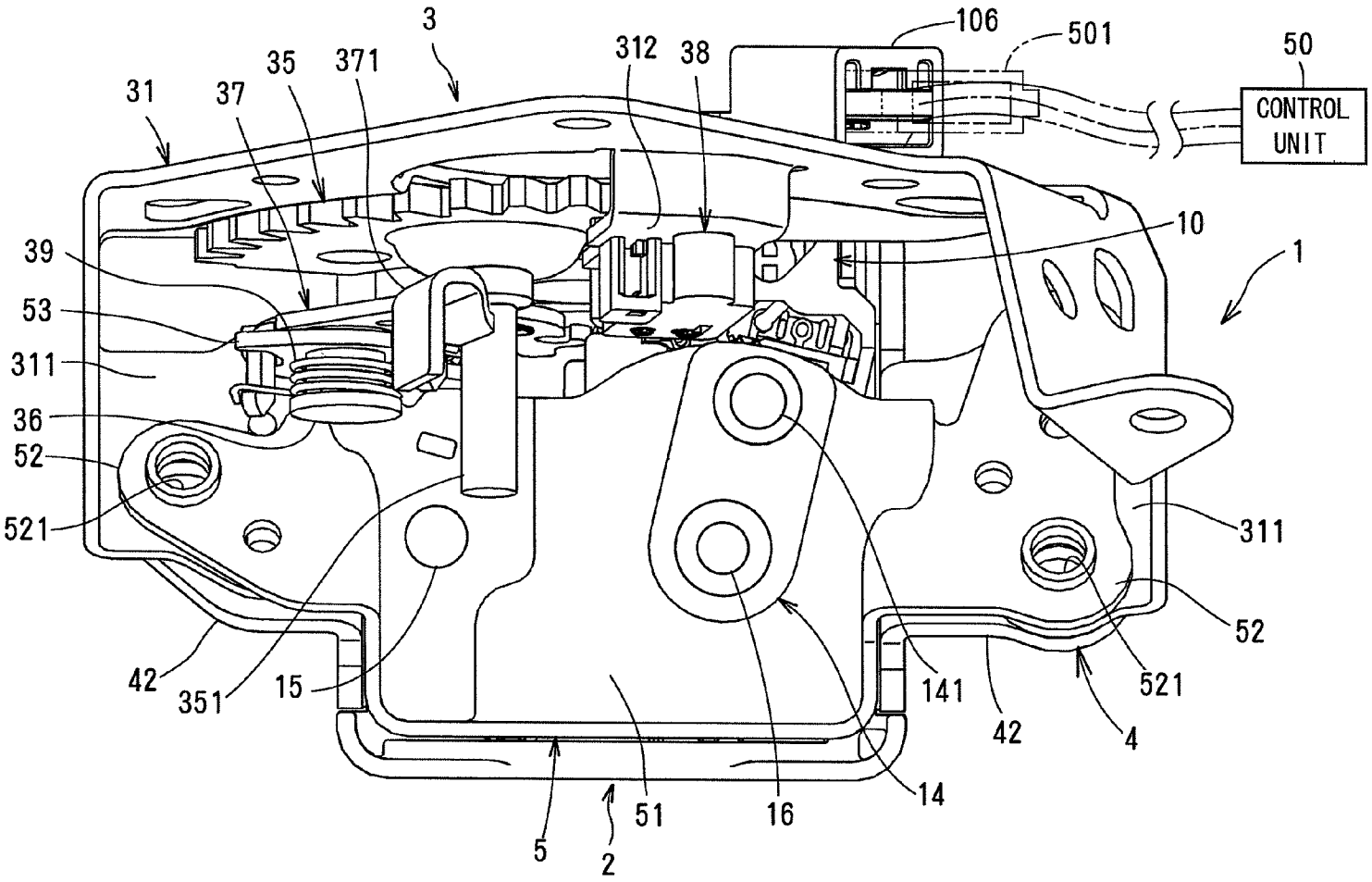
FIG. 2 is a top plan view thereof
Figure 3:
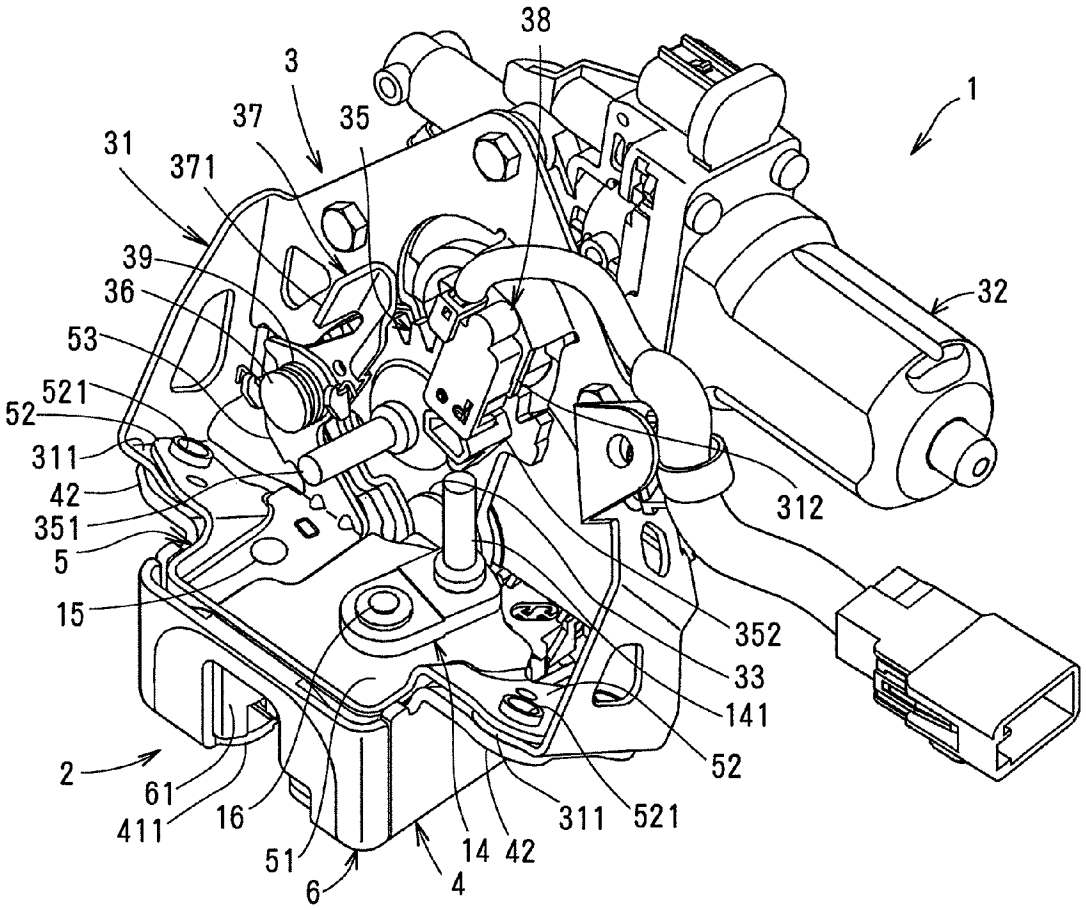
FIG. 3 is a perspective view thereof.
Figure 4:
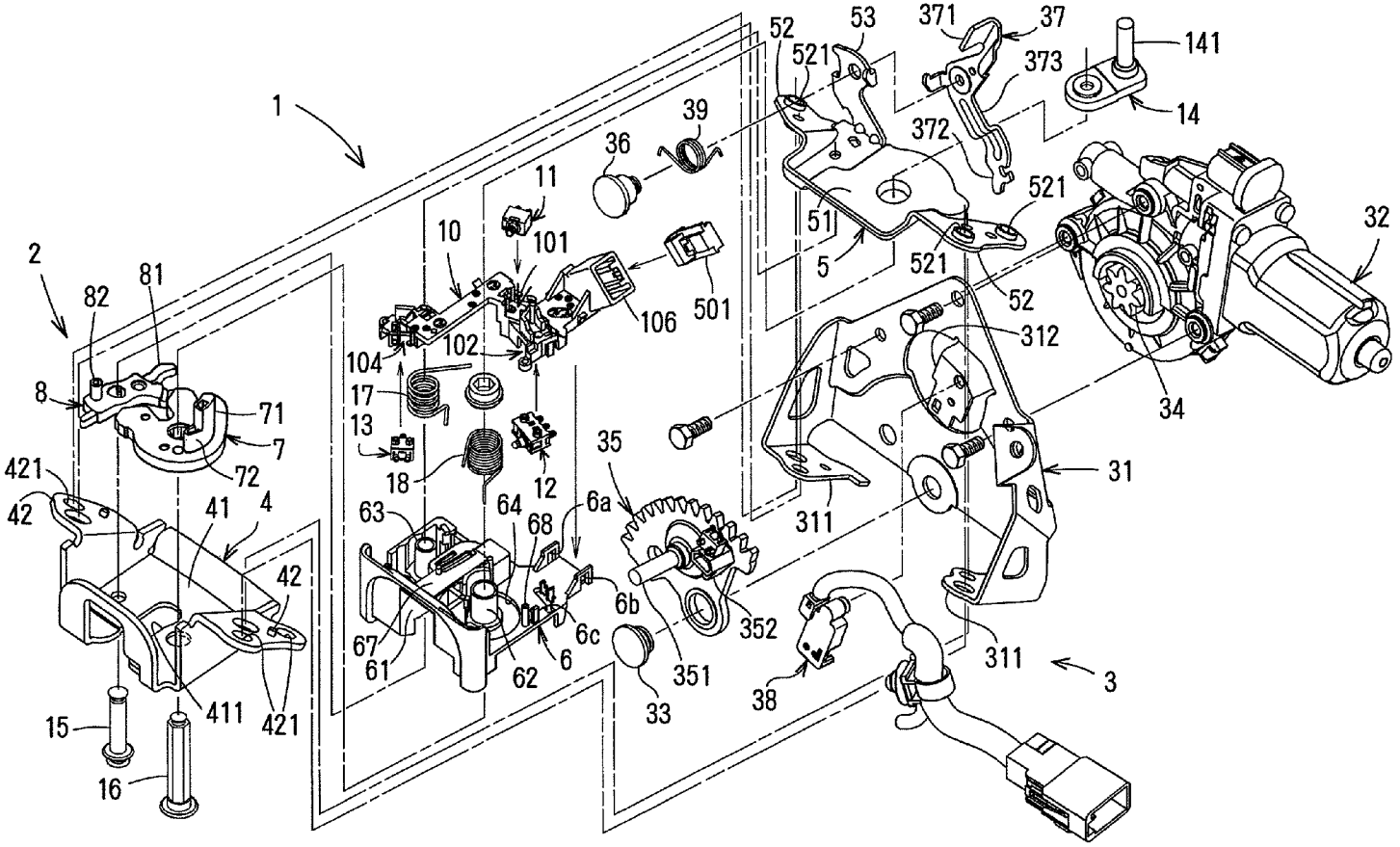
FIG. 4 is an exploded perspective view thereof.

An opening lever 37 is pivotally mounted to the bent portion 53 of the back plate in the middle via a support shaft 36 and held in a standby position in FIG. 1 with a spring 39 wound on the support shaft 36. The opening lever 37 has a motion-input portion 371 at the upper end opened with a door handle disposed on the exterior of the liftgate, and a contact portion 372 which can come in contact with a rear end 81 of the ratchet 8 at the lower end in FIGS. 6-8.

When the liftgate is opened with the door handle, the door handle comes in contact with the motion-input portion 371 of the opening lever 37, which turns against the force of the spring 39 in the releasing direction or in a clockwise direction in FIG. 1 to allow the contact portion 372 to come in contact with the rear end 81 of the ratchet 8, so that the ratchet 8 turns in the releasing direction to enable the door to open.

The sector gear 35 comprises a cylindrical pressing portion 351 which projects forward, and a detected portion 352. When the pinion 34 rotates with normal rotation of the motor 32, the sector gear 35 rotates in the releasing direction or in the clockwise direction from a neutral position in FIG. 1. When the pinion 34 rotates with reverse rotation of the motor 32, the sector gear 35 rotates from a closing direction or in the counterclockwise direction in FIG. 1.

When the liftgate is closed, the switch (not shown) is operated to open the door, and a control unit 50 in the vehicle body controls the motor 32 to rotate normally. Thus, the sector gear 35 turns in the releasing direction from the neutral position by the motor 32. The left side of the pressing portion 351 presses a contacted portion 373 at the right side of the opening lever 37 from the right side in a turning direction to enable the opening lever 37 to turn in the releasing direction, so that the liftgate can be opened.

With closing of the liftgate, the latch 7 turns to right before the half-latch position from the open position. On the basis of a half-latch detecting signal of the latch 7 detected by the half-latch detecting switch 11, the control unit 50 controls the motor 32 to rotate reversely. Thus, the sector gear 35 turns in the closing direction from the neutral position by the motor 32, and the right side of the pressing portion 351 presses the projection 141 of the latch lever 14 in the turning direction to allow the latch 7 to turn from the half-latch position to the full-latch position via the latch lever 14, so that the liftgate is forcedly closed from a slightly-open state to a completely closed state. When the full-latch detecting switch 12 detects the full-latch position of the latch 7, the control unit 50 controls the motor 32 to rotate normally to allow the sector gear 35 to return to the neutral position.

The sector-gear-detecting switch 38 is fixed on the front face of a switch-mounting portion 312 of the base plate 31, and detects a neutral position of the sector gear 35 by contacting a retractable detecting portion 381 with the detected portion 352 of the sector gear 35. A detected signal in the sector-gear-detecting switch 38 is transmitted to the control unit 50. The control unit 50 stops the motor 32 based on the neutral signal detected by the sector-gear-detecting switch 38.

Then, the terminal block 10 will be described. In FIG. 10, the half-latch conductive plate 9A, full-latch conductive plate 9B and ratchet conductive plate 9C are formed by insert molding in the terminal block 10, and is fixed on the upper surface of the body 6 over the striker-engagement groove 61 of the body 6.

There are integrally molded a half-latch-detecting-switch holding portion 101 that has an elastic claw 107 which engages an upper surface of the half-latch detecting switch 11 to hold the half-latch detecting switch 11 in a recess 1011 without coupling means such as a bolt in the terminal block 10 at the right side of the striker-engagement groove 61 of the body 6; a full-latch-detecting-switch holding portion 102 that has an elastic claw 108 which engages with a lower surface of the full-latch detecting switch in a recess without coupling means such as a bolt; a positioning hole 103 in which a positioning protrusion 68 engages to determine a right-side position of the terminal block 10; and a coupler 106 connected to an external connector 501 which is connected to the control unit 50 via an external wire harness. There are integrally molded that has an elastic claw 109 which engages with a lower surface of the ratchet-detecting switch 13 to hold the ratchet-detecting switch 13 in a recess 1041 without coupling means such as a bolt.

The positioning holes 103,105 engage with the positioning protrusions 68,69 of the body 6 and the terminal block 10 engages with the claws 6*a*-6*c* of the body 6.

The half-latch-detecting-switch holding portion 101 and the full-latch-detecting-switch holding portion 102 are provided on one and the other sides of the terminal block 10 respectively. The half-latch detecting switch 11 and the full-latch detecting switch 12 are disposed along a rotation axis of the latch 7 on the terminal block 10. Hence, the half-latch detecting switch 11 and the full-latch detecting switch 12 can be disposed in a smaller space.

In FIG. 10, the half-latch conductive plate 9A and the full-latch conductive plate 9B are formed by insert molding such that terminals 92A,92B at the rear end thereof are exposed in the coupler 106 and connecting terminals 91A, 91B at the front end thereof are exposed in the half-latch-detecting-switch holding portion 101 and the full-latch-detecting-switch holding portion 102.

In order to connect the right-side coupler 106 and the left-side ratchet detecting switch 61 electrically, the ratchet conductive plate 9C is formed in the terminal block 10 across the striker-engagement groove 61 such that the terminal 92C at the rear end is exposed in the coupler 106 and a connecting terminal 91C at the front end is exposed in the ratchet-detecting-switch holding portion 104.

The terminals 92A,92B,92C of the conductive plates 9A,9B.9C exposed in the coupler 106 are electrically connected to terminals of an external connector 501 by connecting the external connector 501 to the coupler 106.

The half-latch detecting switch 11 is placed downward in the recess 1011 of the half-latch-detecting-switch holding portion 101 of the terminal block 10 and comes in contact with the end of the elastic claw 107. The half-latch detecting switch 11 is held in the half-latch-detecting-switch holding portion 101 such that the retractable detecting portion 112 faces the outer circumferential surface of the first detected portion 71 of the latch 7, and the terminal 111 which projects from a casing of the half-latch detecting switch 11 is directly coupled to the connecting terminal 91A of the half-latch conductive plate 9A.

The full-latch detecting switch 12 is placed upward in a recess 1021 of the full-latch-detecting-switch holding portion 102 of the terminal block 10 and is in contact with the end of an elastic claw 108. The full-latch detecting switch 12 is held in the full-latch-detecting-switch holding portion 102 such that a retractable detecting portion 122 faces the outer circumferential surface of a second detected portion 72 of the latch 7, and a terminal 121 which projects from a casing of the full-latch detecting switch 12 is directly coupled to the connecting terminal 91B of the full-latch conductive plate 9B.

The ratchet detecting switch 13 is placed in the recess 1041 of the ratchet-detecting-switch holding portion 104 of the terminal block 10 upward and is in contact with the end of the elastic claw 109. The ratchet detecting switch 13 is held in the ratchet-detecting-switch holding portion 104 such that a retractable detecting portion 132 faces the detected portion 82 of the ratchet 8. A terminal 131 which projects from a casing of the ratchet detecting switch 13 is directly coupled to the connecting terminal 91C of the ratchet conductive plate 9C.

Figure 13:
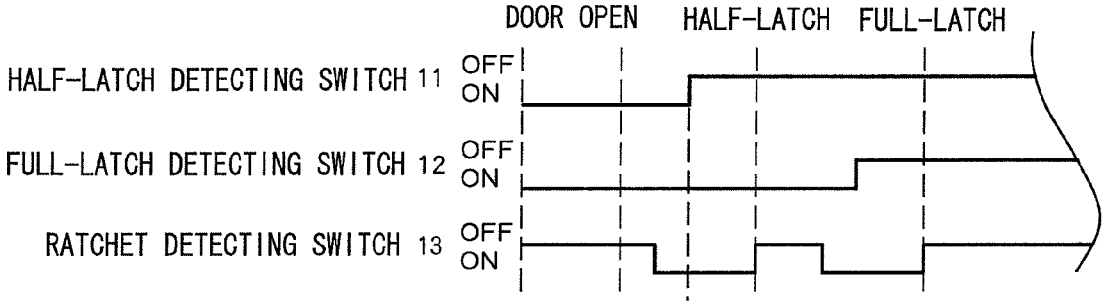
FIG. 13 is a timing chart of detecting switches.

As shown in the timing chart in FIG. 13, as the liftgate closes, the latch 7 turns from the open position to just before the half-latch position, and the detecting portion 111 leaves the outer circumferential surface of the first detected portion 71. The half-latch detecting switch 11 turns from ON to OFF to detect the half-latch position. The half-latch detecting signal of the latch 7 detected by the half-latch detecting switch 11 is supplied from the terminal 92A through the full-latch conductive plate 9A and transmitted to the control unit 50 via an external connector 501 connected to the coupler 106.

As shown in the timing chart in FIG. 13, when the latch 7 turns from the half-latch position to just before the full-latch position, the detecting portion 122 of the full-latch detecting switch 12 leaves the outer circumferential surface of the detected portion 72 of the latch 7, and the full-latch detecting switch 12 turns from ON to OFF to detect the full-latch position of the latch 7. A full-latch detecting signal of the latch 7 detected by the full-latch detecting switch 12 is supplied to the terminal 92B via the full-latch conductive plate 9B and transmitted to the control unit 50 via the external connector 501 connected to the coupler 106.

When the ratchet 8 turns in the releasing direction from the engagement position, the detected portion 82 of the ratchet 8 comes in contact with the detecting portion 132, so that the ratchet detecting switch 13 turns from OFF to ON to detect that the ratchet 8 turns to the release position. A release detecting signal of the ratchet 8 detected by the ratchet detecting switch 13 is supplied from the terminal 92C via the ratchet conductive plate 9C and transmitted to the control unit 50 via the external connector 501 connected to the coupler 106.

As mentioned above, the conductive plates 9A,9B,9C are formed in the terminal block 10 by insert molding, and the holding portions 101,102,104 which hold the detecting switches 11,12,13 without coupling means are integrally molded. Furthermore, the detecting switches 11,12,13 held in the holding portions 101,102,104 are electrically connected to the connecting terminals 91A,91B,91C directly. Thus, the terminal block 10 in which the detecting switches 11,12,13 are connected is fixed to the body 6, so that the detecting switches 11,12,13 are connected to the body 6 of the engagement unit 2 readily and securely without using wire harness.

The coupler 106 is integrally molded with the terminal block 10 and the conductive plates 9A,9B,9C are exposed in the coupler 106 thereby enabling a detecting signal from the detecting switches 11,12,13 to be supplied to the outside.

The terminal block 10 is fixed to the body 6 over the striker-engagement grooves 411,61. The half-latch conductive plate 9A and the full-latch conductive plate 9B which do not cross the striker-engagement grooves 411,61 and the ratchet conductive plate 9C which crosses the striker-engagement grooves 411,61 are formed by insert molding, thereby enabling the latch detecting switches 11,12 to be disposed at one or right side of the striker-engagement grooves 411,61 and the ratchet detecting switch 13 to be disposed at the other or left side. It is not necessary to dispose the ratchet-conductive plate 9C around the striker-engagement grooves 411,61 thereby shortening the length of the ratchet conductive plate 9C and reducing the cost.

Embodiments of the present invention are described, but it is possible to make changes and modifications without departing from the scope of claims.

(i) The cover plate 4 and the body 6 constitute the base member. Instead, the base member may comprise only the cover plate 4 without the body 6. In this case, the terminal block 10 is not fixed to the body 6, but to the cover plate 4.

(ii) The door may be a side door or a sliding door.

What is claimed is:

1. A vehicle door latch device comprising:

a base member having a striker-engagement groove in which a striker of a vehicle body enters;

a latch that is pivotally mounted to the base member and is engagable with the striker in the striker-engagement groove;

a ratchet that is pivotally mounted to the base member and engages with the latch to prevent the latch from turning;

a first latch-detecting switch that can detect a first turning position of the latch; and a synthetic-resin terminal block that is fixed to the base member, a latch conductive plate being insert-molded in the terminal block, the terminal block having a first latch-detecting-switch holding portion that holds the first latch detecting switch with an elastic claw, the latch conductive plate having a connecting terminal exposed to the latch-detecting-switch holding portion and electrically connected to the first latch detecting switch directly;

a second latch detecting switch that can detect a second turning position of the latch different from the first turning position of the latch, the terminal block having a second latch-detecting-switch holding portion that can hold the second latch detecting switch, wherein the first latch-detecting-switch holding portion and the second latch-detecting-switch holding portion are formed in different surfaces of the terminal block such that the first latch detecting switch and the second latch detecting switch are stacked and held in the terminal block axially of the latch, wherein the first turning position is a half-latch position where the latch slightly engages with the striker, and the second turning position is a full-latch position where the latch completely engages with the striker; and a ratchet detecting switch that can detect a turning position of the ratchet, the terminal block having a ratchet-detecting-switch holding portion that holds the ratchet detecting switch with an elastic claw;

the terminal block having an elongated central portion configured for being fixed to the base member, wherein said elongated central portion of the terminal block is over the striker-engagement groove and extends along a longitudinal direction of the striker-engagement groove; and the first and second latch-detecting-switch holding portions are formed in the terminal block at one side of the elongated central portion and the striker-engagement groove, and the ratchet-detecting-switch holding portion is formed in the terminal block at an opposite side of the elongated central portion and the striker-engagement groove.

2. The vehicle door latch device of claim 1 wherein a ratchet conductive plate electrically connected to the ratchet detecting switch is formed in the terminal block by insert molding.

3. The vehicle door latch device of claim 2 wherein the ratchet conductive plate has a connecting terminal exposed in the ratchet-detecting-switch holding portion and directly connected to the ratchet detecting switch electrically.

4. The vehicle door latch device of claim 2 wherein the ratchet conductive plate is formed by insert molding in the terminal block to cross over the striker-engagement groove.

5. The vehicle door latch device of claim 1 wherein the terminal block is integrally molded with a coupler connected to an external connector connected to an external wire harness.

6. The vehicle door latch device of claim 5 wherein ends of the latch conductive plate and ratchet conductive plate are exposed in the coupler to form terminals electrically connected to terminals of external connectors.

7. The vehicle door latch device of claim 5 wherein the coupler is formed at one side on the terminal block with respect to the striker-engagement groove.

* * * * *